US009446423B2

(12) United States Patent
Hu

(10) Patent No.: US 9,446,423 B2
(45) Date of Patent: Sep. 20, 2016

(54) AIR GUN WITH SUCKING FUNCTION

(71) Applicant: Kuei-Chu Hu, Taichung (TW)

(72) Inventor: Kuei-Chu Hu, Taichung (TW)

(73) Assignee: Kuei-Chu Hu, Taichung (TW)

( * ) Notice: Subject to any disclaimer, the term of this patent is extended or adjusted under 35 U.S.C. 154(b) by 136 days.

(21) Appl. No.: 14/500,818

(22) Filed: Sep. 29, 2014

(65) Prior Publication Data

US 2016/0089683 A1 Mar. 31, 2016

(51) Int. Cl.

| | |
|---|---|
| ***B05B 9/01*** | (2006.01) |
| ***A47L 9/08*** | (2006.01) |
| ***B08B 5/02*** | (2006.01) |

(52) U.S. Cl.
CPC .. *B05B 9/01* (2013.01); *B08B 5/02* (2013.01)

(58) Field of Classification Search
CPC ..... B05B 9/01; A47L 9/08; A47L 5/24; A47L 5/26; A47L 5/14; A47L 5/28; A47L 5/18; B08B 5/02
See application file for complete search history.

(56) References Cited

U.S. PATENT DOCUMENTS

| | | | | | |
|---|---|---|---|---|---|
| 3,683,446 | A * | 8/1972 | Tell | A47L 9/08 | 141/389 |
| 3,967,341 | A * | 7/1976 | Gavin | B08B 5/04 | 15/345 |
| 4,055,870 | A * | 11/1977 | Furutsutsumi | A47L 5/14 | 15/330 |
| 4,629,128 | A * | 12/1986 | Lawrence | B05B 1/005 | 134/166 R |
| 5,924,166 | A * | 7/1999 | Jones | A47L 5/14 | 15/330 |

* cited by examiner

*Primary Examiner* — Dung Van Nguyen
(74) *Attorney, Agent, or Firm* — Senniger Powers LLP

(57) ABSTRACT

An air gun with sucking function comprises a gun body, an air intake control set and an airflow switching and controlling element. The air gun with sucking function of the present invention employs the airflow switching and controlling element disposed inside the gun tube of the gun body for switching an airflow flowing direction and converting an airflow ejection into a sucking airflow in order to meet various work requirements by switching to different functions. When it is switched for sucking airflow for cleaning, dust can be prevented from flying around and therefore is healthier for breathing.

8 Claims, 6 Drawing Sheets

AIR GUN WITH SUCKING FUNCTION

BACKGROUND OF THE INVENTION

1. Field of Invention

The present invention relates to an air gun with sucking function and more particularly to an air gun with an airflow switching and controlling element disposed inside a gun tube of a gun body for switching an airflow direction in order to eject or suck the airflow for meeting various work requirements by providing different functions. When it is switched for sucking airflow for cleaning, dust can be prevented from flying around and therefore is healthier for breathing. The design inside the gun body can cause the airflow to eject with a higher pressure for drawing the air in the back to move forward. As a result, both the air amount supplied by an air compressor and the operational load can be reduced, and therefore energy consumption, carbon footprint and operational costs can be reduced.

2. Related Art

Conventional air gun is commonly used for blowing and cleaning off dust or dried dirt by controlling a trigger to eject high pressure airflow.

The structure of utility model "An Improved Structure of Air Spray Gun" with filing number 97217462 and publication number M397289 dated Jan. 2, 2011 is described in claim 1: A hose is connected with a high pressure air storing container for ejecting a high pressure air. An air passage is disposed inside a spray gun body, and the spray gun body is pivotally disposed with a movable grip handle by using a spring. The movable grip handle is assembled with a stopping pin inserted inside the air passage correspondingly. An air guiding groove is radially disposed above the stopping pin. Accordingly, the high pressure air can be guided effectively for blocking the air passage with the stopping pin in order to prevent the high pressure air from leaking.

However, blowing and cleaning off dust or dirt by ejecting high pressure current will cause the dust to fly around to adversely affect the air quality, which is bad for health. Furthermore, doing clean off by ejecting air is not suitable for using in certain work conditions due to the limitations; or, in some dirty environments, sucking air for cleaning off is a lot more easy than ejecting air.

However, common spray guns in the market, such as the one with the publication number above, do not have the function for switching into sucking mode; therefore are useless in work environments where sucking air is the only option. As a result, a vacuum cleaner is used for cleaning off, which is inconvenient. This is a first drawback of the conventional spray guns.

Furthermore, as mentioned previously, blowing and cleaning off dust or dirt by ejecting high pressure current will cause the dust to fly around and the air quality to worsen, which is bad for health. This is a second drawback of the conventional spray guns.

SUMMARY OF THE INVENTION

The present invention of an air gun with sucking function aims to solve the drawbacks of being useless in work environments where sucking air is the only option for cleaning off dust and dirt; and causing the dust to fly around, air quality to worsen and bad effects for health of the above mentioned conventional spray guns.

A primary objective of the present invention is to provide an air gun with sucking function with an airflow switching and controlling element disposed inside a gun tube of a gun body for switching an airflow direction in order to eject or suck the airflow for meeting various work requirements by providing different functions.

A secondary objective of the present invention is to provide an air gun with sucking function. When the air gun is switched for sucking airflow to clean off dust and dirt, it can effectively prevent the dust from flying around, air quality from worsening and provide a healthier environment for breathing.

A third objective of the present invention is to provide an air gun with sucking function. The space structural design inside the gun body for guiding and ejecting an airflow can cause the airflow to eject with a higher pressure for drawing the air in the back inside the gun body to move forward. As a result, both the high pressure air amount supplied by an air compressor for the consumption of the gun body and the operational load of the air compressor can be reduced, and therefore energy consumption, carbon footprint and operational costs can be reduced.

An air gun with sucking function provided by the present invention comprising:

a gun body comprising a gun tube composed of a front small diameter tube and a rear large diameter tube, and a grip handle extended downwardly from an end of the gun tube, an air intake passage extended upwardly being disposed at a lower end of the grip handle, an air inlet being disposed in an inner wall of the large diameter tube behind a circular guiding groove for connecting with the air intake passage downwardly, a control chamber being concavely disposed in an upper section of the grip handle underneath the large diameter tube;

an air intake control set sleeved inside the control chamber for controlling a high pressure air intake through the air intake passage to pass through the air inlet and to enter into the gun tube; and an airflow switching and controlling element being a tube body sleeved inside the large diameter tube of the gun body for moving forward and backward inside the large diameter tube to guide an airflow to eject through the small diameter tube and to guide the airflow to form a sucking airflow in a rear end of the gun tube.

Based on the above, the airflow switching and controlling element is a tube body comprising a front small diameter section smaller than an inner wall diameter of the small diameter tube and a rear large diameter section smaller than an inner wall diameter of the large diameter tube. A protruded control flange is disposed around an outer wall of the small diameter section. An outer conical surface with a front small diameter and a rear large diameter is formed on an outer wall of a front end of the small diameter section. A circular portion is formed between the large diameter section and the small diameter section, and backward guiding holes are circularly disposed in the circular portion. The small diameter section is inserted into the gun body from a rear end of the large diameter tube in order for the protruded control flange to form a front rebound pressing space with a tight separation against the inner wall of the large diameter tube for ejecting an airflow and to form a rear circular pressing space relative to the circularly disposed backward guiding holes for sucking an airflow.

Based on the above, when the rebound pressing space for ejecting airflow corresponds with the air inlet during forward and backward adjustment, the outer conical surface at the front end of the small diameter section and an inner end of the small diameter tube correspondingly form a circular opening for ejecting airflow to force the airflow inside the small rebound pressing space for ejecting airflow to compress through the circular opening for ejecting airflow for forming the airflow ejection with an enhanced pressure. When the circular pressing space for sucking airflow corresponds with the air inlet during forward and backward adjustment, the airflow inside the small circular pressing space for sucking airflow is compressed and guided through the circular backward guiding holes for forming a sucking airflow with an enhanced pressure.

Based on the above, a plurality of equidistant forward and backward guiding portions is protrudingly disposed inside the circular guiding groove formed between the inner end of the small diameter tube and the inner wall of the large diameter tube of the gun tube. A plurality of forward and backward guiding plates with a quantity the same as that of the forward and backward guiding portions is protrudingly disposed on an outer circumference of the protruded control flange of the airflow switching and controlling element. Each of the forward and backward guiding plates is a pointed plate with two slant guiding sides protrudingly disposed towards the front end of the small diameter section and on the outer circumference of the protruded control flange.

Based on the above, the small diameter section of the airflow switching and controlling element is inserted into the gun body from the rear end of the large diameter tube to cause each of the forward and backward guiding plates to insert into the circular guiding groove between each of the forward and backward guiding portions correspondingly. When the airflow switching and controlling element turns, the protruded control flange is guided by the slant guiding sides of each of the forward and backward guiding plates and the forward and backward guiding portions to move forward and backward relative to the air inlet.

Based on the above, a protruded turning flange with circularly disposed teeth is disposed on an outer wall of the large diameter section of the airflow switching and controlling element protruded from the rear end of the large diameter tube.

Based on the above, the air intake control set comprises a cylindrical air intake control element with a shaft hole disposed inside, and at least one airflow orifice is disposed in an outer wall of the air intake control element; and a control shaft with a screw thread section at one end and a stopping portion at another end. The screw thread section is inserted into the shaft hole of the air intake control element. The protruded end after the insertion is sleeved with a spring and coupled with a pressing button. Accordingly, the spring causes the stopping portion of the control shaft to cover an end of the shaft hole constantly in a close status, and the stopping portion to detach from the end of the shaft hole in an open status when pressing the control shaft with the pressing button.

Based on the above, the air intake control set is coupled inside the control chamber of the grip handle of the gun body for causing the airflow orifice of the air intake control set and the air inlet to connect with each other correspondingly.

An air gun with sucking function of the present invention with another combinational structure comprising:

a gun body comprising a gun tube composed of a front small diameter tube and a rear large diameter tube, and a grip handle extended downwardly from an end of the gun tube, a circular guiding groove being formed between the inner end of the small diameter tube and an inner wall of the large diameter tube of the gun tube, an air intake passage extended upwardly being disposed at a lower end of the grip handle, an air intake control set being disposed inside the air intake passage for controlling and guiding a high pressure air, an air inlet being disposed in an inner wall of the large diameter tube behind the circular guiding groove for connecting with the air intake passage downwardly; and an airflow switching and controlling element being a tube body comprising a front small diameter section smaller than an inner wall diameter of the small diameter tube and a rear large diameter section smaller than an inner wall diameter of the large diameter tube, a protruded control flange being disposed around an outer wall of the small diameter section, an outer conical surface with a front small diameter and a rear large diameter being formed on an outer wall of a front end of the small diameter section, a circular portion being formed between the large diameter section and the small diameter section, and backward guiding holes being circularly disposed in the circular portion, the small diameter section being inserted into the gun body from a rear end of the large diameter tube in order for the protruded control flange to form a front rebound pressing space with a tight separation against the inner wall of the large diameter tube for ejecting an airflow and to form a rear circular pressing space relative to the circularly disposed backward guiding holes for sucking an airflow, when the rebound pressing space for ejecting airflow being adjusted to correspond with the air inlet, the outer conical surface at the front end of the small diameter section and an inner end of the small diameter tube correspondingly form a circular opening for ejecting airflow, when the airflow switching and controlling element being adjusted forward to push the outer conical surface and to reduce the circular opening for ejecting airflow, the ejecting airflow being compressed for increasing the airflow pressure, and the air in the back inside the gun body being drawn to move forward for increasing the pressure of ejecting.

The present invention will become more fully understood by reference to the following detailed description thereof when read in conjunction with the attached drawings.

BRIEF DESCRIPTION OF THE DRAWINGS

FIG. 3-1 is a sectional view of operational adjustment of a protruded control flange in different positions relative to an air inlet of the air gun with sucking function of the present invention;

DETAILED DESCRIPTION OF THE INVENTION

Figure 1:
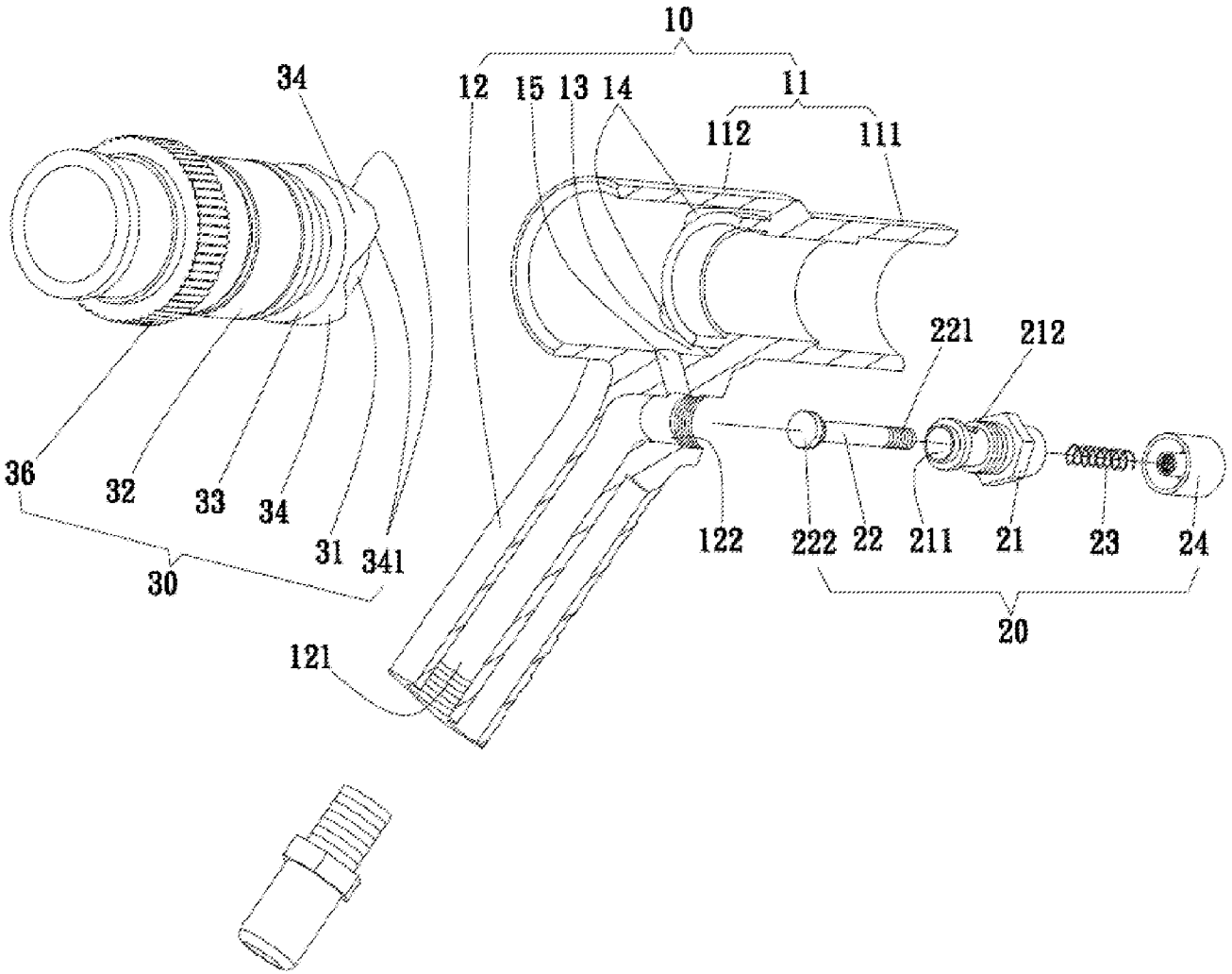
FIG. 1 is a perspective explosive view of an air gun with sucking function of the present invention.
Figure 2:
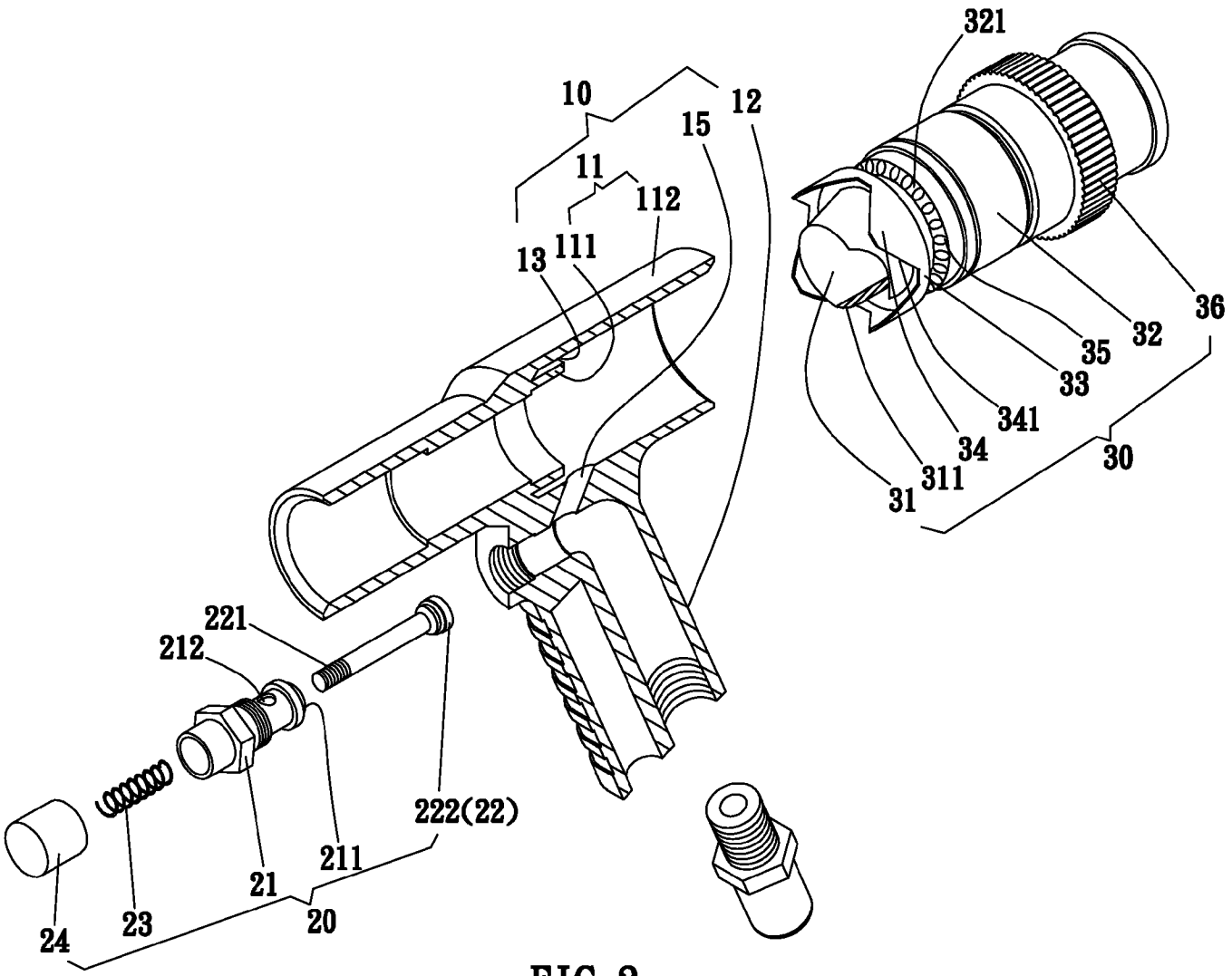
FIG. 2 is a partial sectional perspective explosive view from another direction of the air gun with sucking function of the present invention.

Please refer to FIGS. 1 and 2. FIG. 1 is a perspective explosive view of an air gun with sucking function of the present invention; and FIG. 2 is a partial sectional perspective explosive view from another direction of the air gun with sucking function of the present invention. An air gun with sucking function of the present invention comprises a gun body 10, an air intake control set 20 and an airflow switching and controlling element 30.

The gun body 10 comprises a gun tube 11 composed of a front small diameter tube 111 and a rear large diameter tube 112, and a grip handle 12 extended downwardly from an end of the gun tube 11. A plurality of equidistant forward and backward guiding portions 14 is protrudingly disposed inside a circular guiding groove 13 formed between the inner end of the small diameter tube 111 and the inner wall of the large diameter tube 112. An air intake passage 121 extended upwardly is disposed at a lower end of the grip handle 12. An air inlet 15 is disposed in an inner wall of the large diameter tube 112 behind the circular guiding groove 13 for connecting with the air intake passage 121 downwardly. A control chamber 122 is concavely disposed in an upper section of the grip handle 12 underneath the large diameter tube 112. An air intake control set 20 is coupled inside the control chamber 122. An inner end of the control chamber 122 is connected with the air inlet 15 and the air intake passage 121 so that a high pressure air guided by the air intake passage 121 can be guided through the air inlet 15 to the gun tube 11 for ejection under the control of the air intake control set 20.

The air intake control set 20 comprises a cylindrical air intake control element 21 with a shaft hole 211 disposed inside, and at least one airflow orifice 212 is disposed in an outer wall of the air intake control element 21; and a control shaft 22 with a screw thread section 221 at one end and a stopping portion 222 at another end. The screw thread section 221 is inserted into the shaft hole 211 of the air intake control element 21. The protruded end after the insertion is sleeved with a spring 23 and coupled with a pressing button 24. Accordingly, the spring 23 causes the stopping portion 222 of the control shaft 22 to cover an end of the shaft hole 211 constantly in a close status, and the stopping portion 222 to detach from the end of the shaft hole 211 in an open status when pressing the pressing button 24.

The airflow switching and controlling element 30 is a tube body comprising a front small diameter section 31 smaller than an inner wall diameter of the small diameter tube 111 and a rear large diameter section 32 smaller than an inner wall diameter of the large diameter tube 112. A protruded control flange 33 is disposed around an outer wall of the small diameter section 31. An outer conical surface 311 with a front small diameter and a rear large diameter is formed on an outer wall of a front end of the small diameter section 31. A plurality of forward and backward guiding plates 34 with a quantity the same as that of the forward and backward guiding portions 14 is protrudingly disposed on an outer circumference of the protruded control flange 33. Each of the forward and backward guiding plates 34 is a pointed plate with two slant guiding sides 341 protrudingly disposed towards a front end of the small diameter section 31 and on the outer circumference of the protruded control flange 33. A circular portion 321 is formed between the large diameter section 32 and the small diameter section 31, and backward guiding holes 35 are circularly disposed in the circular portion 321 for guiding toward an inner wall of the large diameter section 32. A protruded turning flange 36 with circularly disposed teeth is disposed on an outer wall of the large diameter section 32 of the airflow switching and controlling element 30 protruded from a rear end of the large diameter tube 112.

Figure 3:
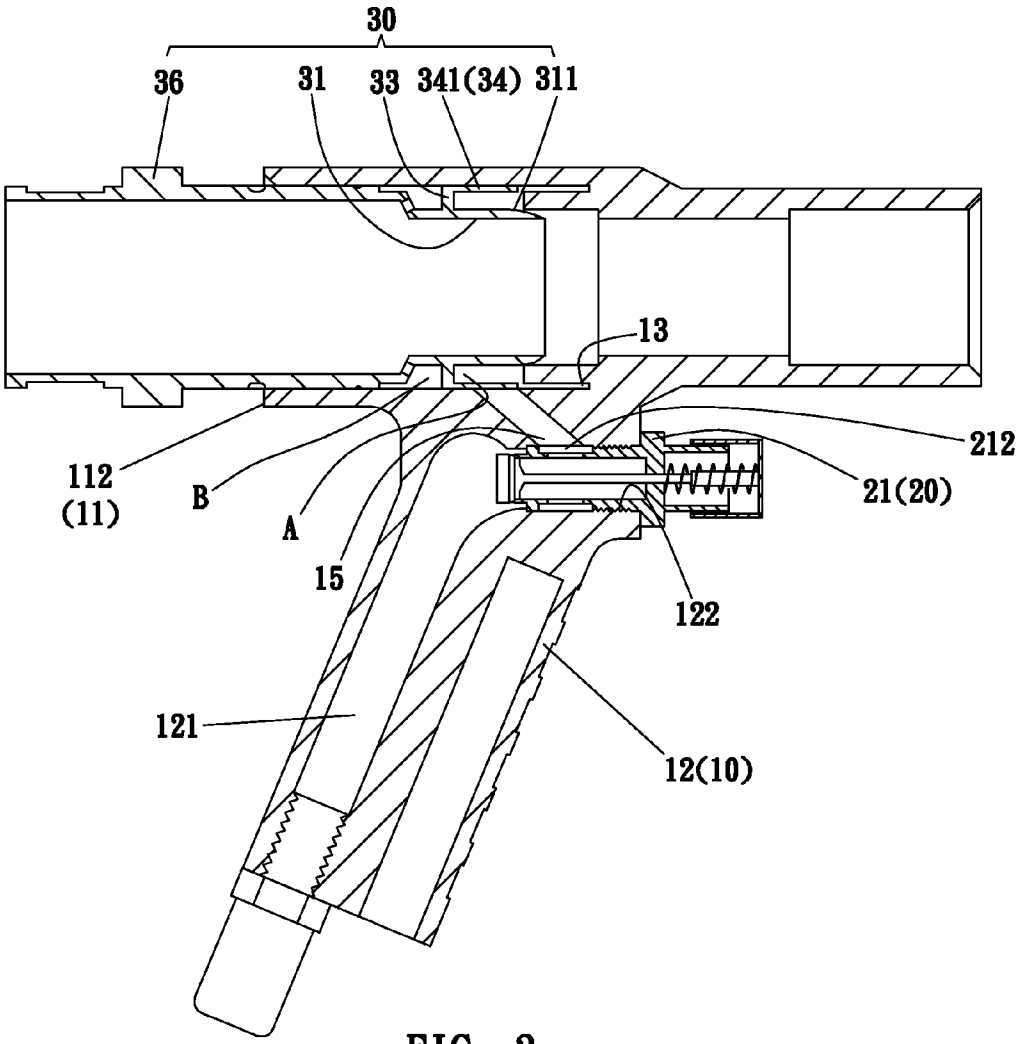
FIG. 3 is a sectional assembly view of the air gun with sucking function of the present invention.
Figures 1, 3:
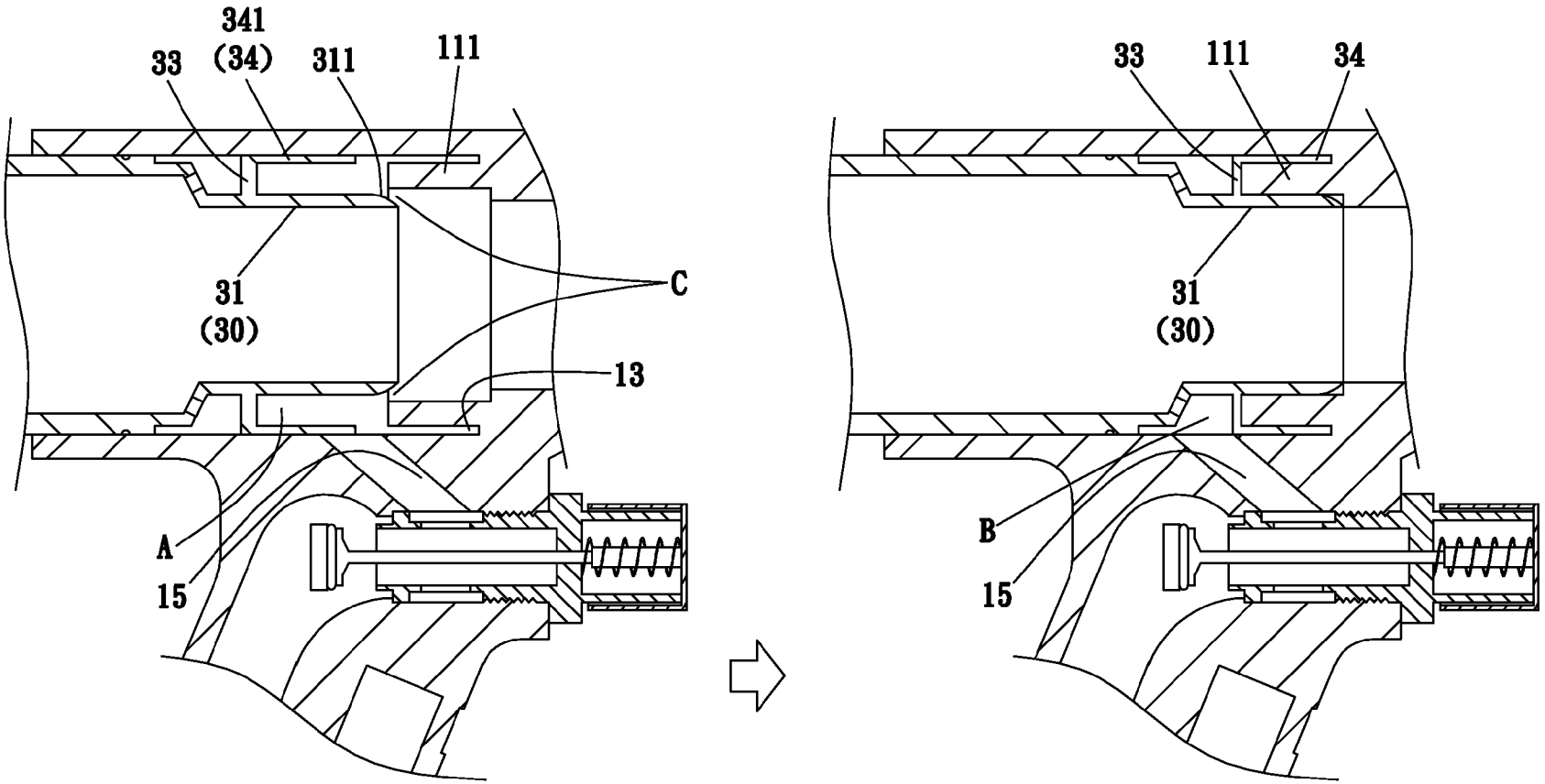

Please refer to FIG. 3. FIG. 3 is a sectional assembly view of the air gun with sucking function of the present invention. The air intake control element 21 of the air intake control set 20 is coupled inside the control chamber 122 of the grip handle 12 of the gun body 10 in order that the airflow orifice 212 and the air inlet 15 are connected. The small diameter section 31 of the airflow switching and controlling element 30 is inserted into the gun body 10 from the rear end of the large diameter tube 112 to cause each of the forward and backward guiding plates 34 to insert into the circular guiding groove 13 between each of the forward and backward guiding portions 14 correspondingly as shown in FIG. 1. Thus, the protruded control flange 33 is closely pressed against the inner wall of the large diameter tube 112 of the gun tube 11. Accordingly, a front rebound pressing space A is formed with a tight separation against the inner wall of the large diameter tube 112 for ejecting an airflow with an enhanced pressure, and a rear circular pressing space B for sucking airflow is also formed. Furthermore, the outer conical surface 311 at the front end of the small diameter section 31 and an inner end of the small diameter tube 111 correspondingly form a circular opening C for ejecting airflow as shown in FIG. 3-1.

Please refer to FIG. 3-1. FIG. 3-1 is a sectional view of operational adjustment of a protruded control flange in different positions relative to an air inlet of the air gun with sucking function of the present invention. By pressing the pressing button 24 of the air intake control set 20 inside the gun body 10, the air intake passage 121 can be controlled for guiding a high pressure air. When the protruded turning flange 36 on an outer surface of the airflow switching and controlling element 30 is turned, the two slant guiding sides 341 (as shown in FIGS. 1 and 2) of each of the forward and backward guiding plates 34 and the forward and backward guiding portions 14 (as shown in FIG. 1) can guide the protruded control flange 33 to move forward and backward in different positions relative to the air inlet 15 as shown in the figures on the left and right.

Figure 4:
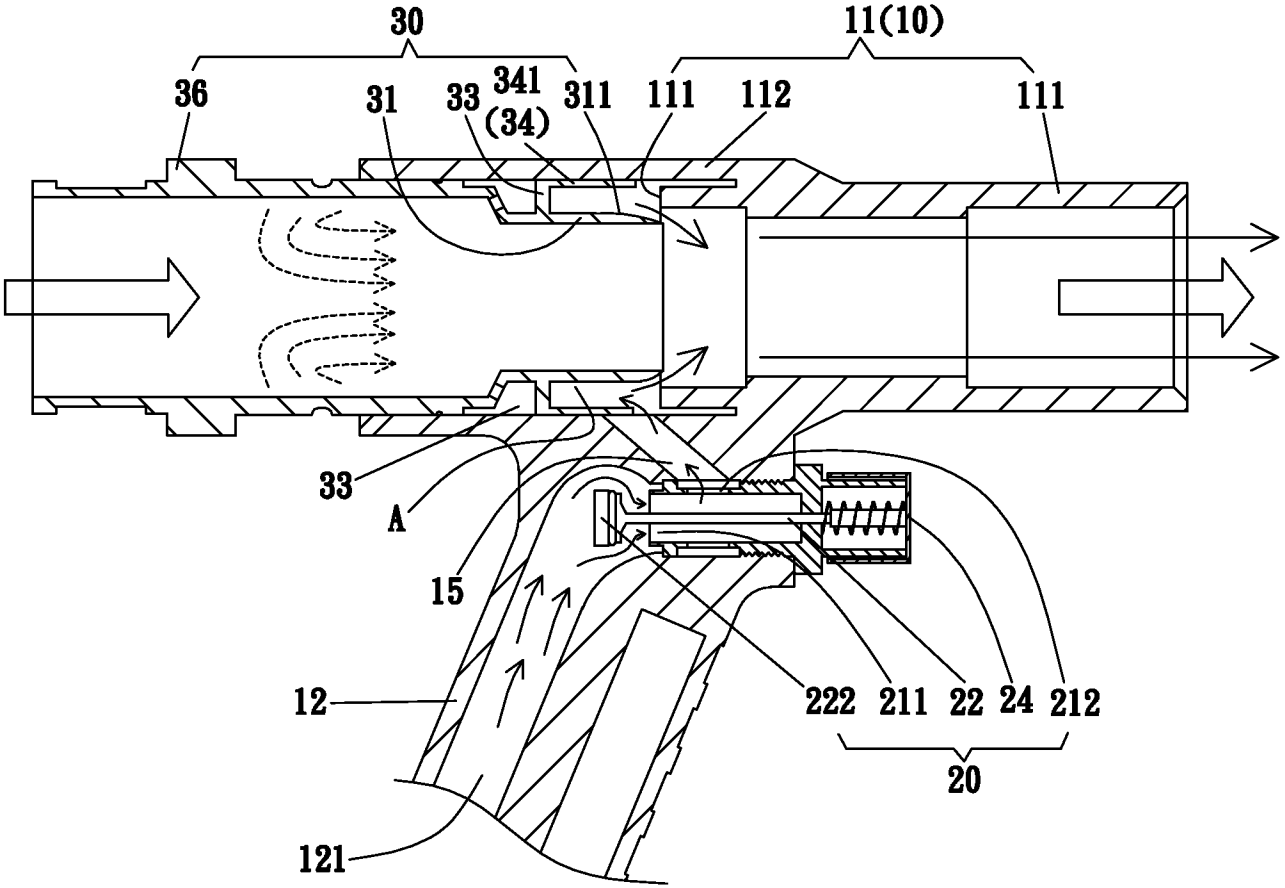
FIG. 4 is a sectional operational view of intaking an airflow for ejection according to the air gun with sucking function of the present invention.

Please refer to FIG. 4. FIG. 4 is a sectional operational view of intaking an airflow for ejection according to the air gun with sucking function of the present invention. When the protruded turning flange 36 on the outer surface of the airflow switching and controlling element 30 is turned, the two slant guiding sides 341 (as shown in FIGS. 1 and 2) of each of the forward and backward guiding plates 34 and the forward and backward guiding portions 14 (as shown in FIG. 1) can guide the protruded control flange 33 to move backward at a rear side of the air inlet 15. When the front rebound pressing space A for ejecting airflow corresponds with the air inlet 15, the outer conical surface 311 at the front end of the small diameter section 31 and the inner end of the small diameter tube 111 correspondingly form a circular opening C for ejecting airflow. When the airflow switching and controlling element 30 is adjusted forward and the outer conical surface 311 is pushed forward, the circular opening C for ejecting airflow is reduced as shown in the left figure of FIG. 3-1. When the control shaft 22 is pressed by the pressing button 24 of the air intake control set 20, the stopping portion 222 is detached from the end of the shaft hole 211 in an open status, and the high pressure air guided through the air intake passage 121 of the grip handle 12 enters into the rebound pressing space A for ejecting airflow inside the gun tube 11 of the gun body 10 through the airflow orifice 212 of the air intake control element 21 and the air inlet 15. The high pressure air is then stopped by the protruded control flange 33 and rebound for ejecting through the small diameter tube 111 as indicated by the arrow in the figure. Therefore, general clean off can be achieved.

Please refer to FIG. 4. The air guided and controlled by pressing the pressing button 24 of the air intake control set 20 to enter inside the gun tube 11 is guided by the protruded control flange 33. As indicated by the arrows in the figure, after the airflow entered into the rebound pressing space A for ejecting airflow inside the forward and backward guiding plates 34 is stopped by the protruded control flange 33 and rebound, the airflow is then pressed by the circular opening C for ejecting airflow between the small diameter section 31 and the small diameter tube 111 to eject forward to achieve a rebound pressing effect. Particularly, when the circular opening C for ejecting airflow is reduced by adjusting the airflow switching and controlling element 30 forward or backward, the airflow ejection is compressed to enhance the airflow pressure, and the air in the back of the gun tube 11 is drawn forward for enhancing the airflow pressure as indicated by the hollow arrow in the figure.

Accordingly, the enhanced airflow ejection pressure draws the air in the back of the gun body 11 forward. As a result, both the high pressure air amount supplied by an air compressor for the consumption of the gun body 10 and the operational load of the air compressor can be reduced, and therefore energy consumption, carbon footprint and operational costs can be reduced.

Figure 5:
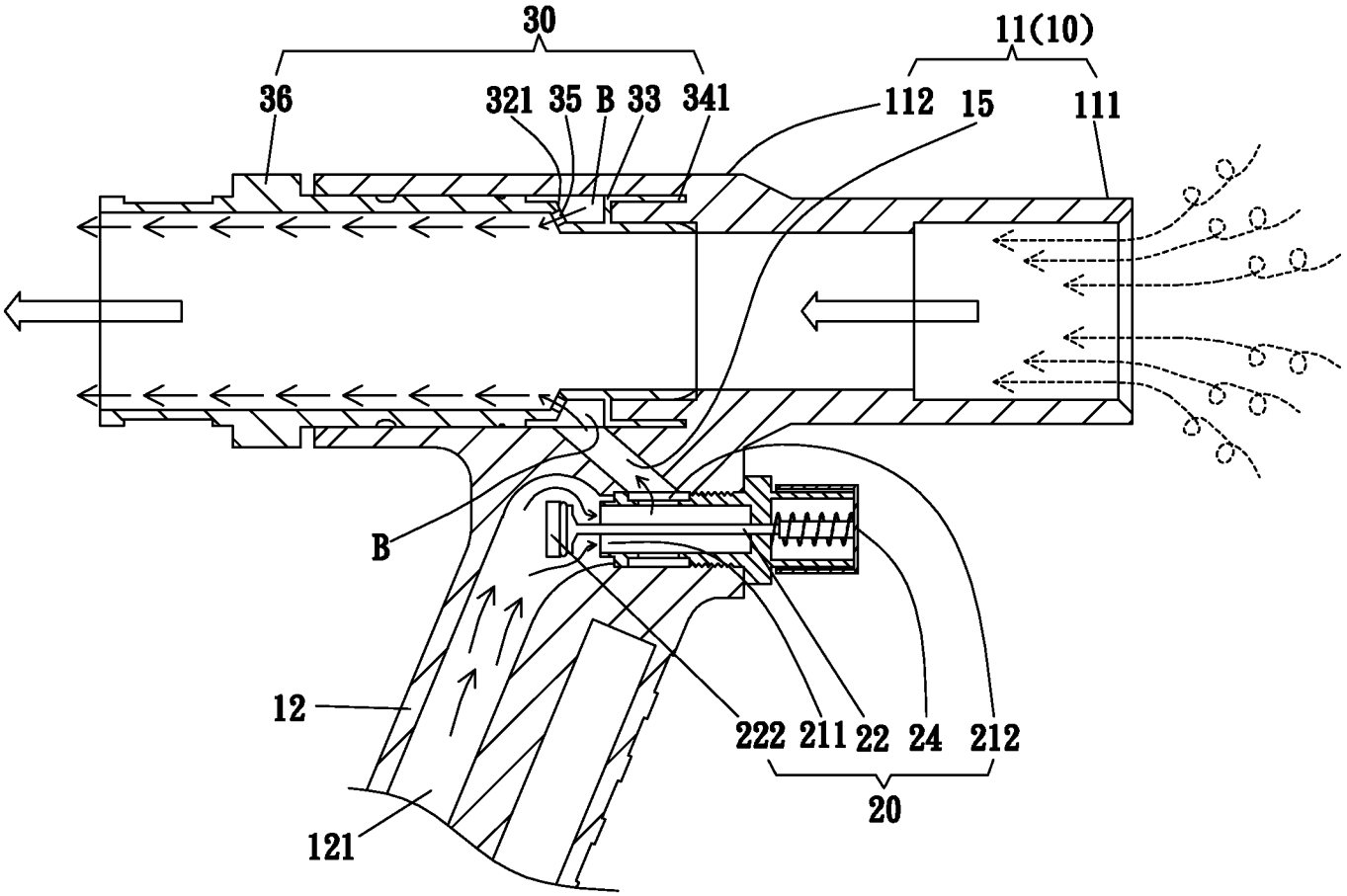
FIG. 5 is a sectional operational view of sucking an airflow according to the air gun with sucking function of the present invention.

Please refer to FIG. 5. FIG. 5 is a sectional operational view of sucking an airflow according to the air gun with sucking function of the present invention. When the protruded turning flange 36 on the outer surface of the airflow switching and controlling element 30 is turned, the two slant guiding sides 341 (as shown in FIGS. 1 and 2) of each of the forward and backward guiding plates 34 and the forward and backward guiding portions 14 (as shown in FIG. 1) can guide the protruded control flange 33 to move forward to position at a front side of the air inlet 15. When the circular pressing space B for sucking airflow corresponds with the air inlet 15; and when the control shaft 22 is pressed by the pressing button 24 of the air intake control set 20, the stopping portion 222 is detached from the end of the shaft hole 211 in an open status, and the high pressure air guided through the air intake passage 121 of the grip handle 12 enters into the circular pressing space B for sucking airflow inside the gun tube 11 of the gun body 10 through the airflow orifice 212 of the air intake control element 21 and the air inlet 15. After the air is pressed inside the small circular pressing space B for sucking airflow, the air with an enhanced pressure is then output backward along the inner wall of the airflow switching and controlling element 30 through the circular backward guiding holes 35 in the circular portion 321 for forming a circular airflow as indicated by the arrows in the figure. Accordingly, the circular airflow with an enhanced air pressure flowing backward is formed for drawing and sucking the air around the front end of the gun tube 11 inside as indicated by the dotted arrows in the figure. Thus, an airflow inside the gun tube 11 flows backward for forming a sucking airflow with an enhanced pressure as indicated by the hollow arrows in the figure.

As shown in FIG. 5, with the sucking airflow with an enhanced pressure indicated by the hollow arrows in the figure and the installation of a dust collecting bag (not shown in the figure) at the outer end of the airflow switching and controlling element 30, clean off can be achieved by sucking. Therefore, dust flying around and the deterioration of air quality can be effectively prevented.

The air gun with sucking function of the present invention employs the airflow switching and controlling element disposed inside the gun tube of the gun body for switching an airflow flowing direction and converting an airflow ejection into a sucking airflow in order to meet various work requirements by switching to different functions. When it is switched for sucking airflow for cleaning, dust can be prevented from flying around and therefore is healthier for breathing. The design inside the gun body can cause the airflow to eject with an enhanced pressure for drawing the air in the back to move forward. As a result, both the air amount supplied by an air compressor and the operational load can be reduced, and therefore energy consumption, carbon footprint and operational costs can be reduced.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. An air gun with sucking function comprising:

a gun body comprising a gun tube composed of a front small diameter tube and a rear large diameter tube, and a grip handle extended downwardly from an end of the gun tube, an air intake passage extended upwardly being disposed at a lower end of the grip handle, an air inlet being disposed in an inner wall of the large diameter tube behind a circular guiding groove for connecting with the air intake passage downwardly, a control chamber being concavely disposed in an upper section of the grip handle underneath the large diameter tube;

an air intake control set sleeved inside the control chamber for controlling a high pressure air intake through the air intake passage to pass through the air inlet and to enter into the gun tube; and an airflow switching and controlling element being a tube body sleeved inside the large diameter tube of the gun body for moving forward and backward inside the large diameter tube to guide an airflow to eject through the small diameter tube and to guide the airflow to form a sucking airflow in a rear end of the gun tube, wherein the airflow switching and controlling element is a tube body comprising a front small diameter section smaller than an inner wall diameter of the small diameter tube and a rear large diameter section smaller than an inner wall diameter of the large diameter tube, wherein a protruded control flange is disposed around an outer wall of the small diameter section, an outer conical surface with a front small diameter and a rear large diameter is formed on an outer wall of a front end of the small diameter section, a circular portion is formed between the large diameter section and the small diameter section, and backward guiding holes are circularly disposed in the circular portion, wherein the small diameter section is inserted into the gun body from a rear end of the large diameter tube in order for the protruded control flange to form a front rebound pressing space with a tight separation against the inner wall of the large diameter tube for ejecting an airflow and to form a rear circular pressing space relative to the circular backward guiding holes for sucking an airflow.

2. The air gun with sucking function of claim 1, wherein when the rebound pressing space for ejecting airflow corresponds with the air inlet during forward and backward adjustment, the outer conical surface at the front end of the small diameter section and an inner end of the small diameter tube correspondingly form a circular opening for ejecting airflow to force the airflow inside the small rebound pressing space for ejecting airflow to compress through the circular opening for ejecting airflow for forming the airflow ejection with an enhanced pressure, and when the circular pressing space for sucking airflow corresponds with the air inlet during forward and backward adjustment, the airflow inside the small circular pressing space for sucking airflow is compressed and guided through the circular backward guiding holes for forming a sucking airflow with an enhanced pressure.

3. The air gun with sucking function of claim 1, wherein a plurality of equidistant forward and backward guiding portions is protrudingly disposed inside a circular guiding groove formed between the inner end of the small diameter tube and the inner wall of the large diameter tube of the gun tube, and a plurality of forward and backward guiding plates with a quantity the same as that of the forward and backward guiding portions is protrudingly disposed on an outer circumference of the protruded control flange of the airflow switching and controlling element, and each of the forward and backward guiding plates is a pointed plate with two slant guiding sides protrudingly disposed towards the front end of the small diameter section and on the outer circumference of the protruded control flange.

4. The air gun with sucking function of claim 3, wherein the small diameter section of the airflow switching and controlling element is inserted into the gun body from the rear end of the large diameter tube to cause each of the forward and backward guiding plates to insert into the circular guiding groove between each of the forward and backward guiding portions correspondingly, and when the airflow switching and controlling element turns, the protruded control flange is guided by the slant guiding sides of each of the forward and backward guiding plates and the forward and backward guiding portions to move forward and backward relative to the air inlet.

5. The air gun with sucking function of claim 1, wherein a protruded turning flange with circularly disposed teeth is disposed on an outer wall of the large diameter section of the airflow switching and controlling element protruded from the rear end of the large diameter tube.

6. The air gun with sucking function of claim 1, wherein the air intake control set comprises a cylindrical air intake control element with a shaft hole disposed inside, at least one airflow orifice is disposed in an outer wall of the air intake control element, and a control shaft with a screw thread section at one end and a stopping portion at another end, the screw thread section is inserted into the shaft hole of the air intake control element, and the protruded end after the insertion is sleeved with a spring and coupled with a pressing button so that the spring causes the stopping portion of the control shaft to cover an end of the shaft hole constantly in a closed state, and the stopping portion to detach from the end of the shaft hole in an open state when pressing the control shaft with the pressing button.

7. The air gun with sucking function of claim 6, wherein the air intake control set is coupled inside the control chamber of the grip handle of the gun body for causing the airflow orifice of the air intake control set and the air inlet to connect with each other correspondingly.

8. An air gun with sucking function comprising:

a gun body comprising a gun tube including a front small diameter tube and a rear large diameter tube, and a grip handle extended downwardly from an end of the gun tube, a circular guiding groove being formed between the inner end of the small diameter tube and an inner wall of the large diameter tube of the gun tube, an air intake passage extended upwardly being disposed at a lower end of the grip handle, an air intake control set being disposed inside the air intake passage for controlling and guiding a high pressure air, an air inlet being disposed in an inner wall of the large diameter tube behind the circular guiding groove for connecting with the air intake passage downwardly; and an airflow switching and controlling element being a tube body comprising a front small diameter section smaller than an inner wall diameter of the small diameter tube and a rear large diameter section smaller than an inner wall diameter of the large diameter tube, a protruded control flange being disposed around an outer wall of the small diameter section, an outer conical surface with a front small diameter and a rear large diameter being formed on an outer wall of a front end of the small diameter section, a circular portion being formed between the large diameter section and the small diameter section, and backward guiding holes being circularly disposed in the circular portion, the small diameter section being inserted into the gun body from a rear end of the large diameter tube in order for the protruded control flange to form a front rebound pressing space with a tight separation against the inner wall of the large diameter tube for ejecting an airflow and to form a rear circular pressing space relative to the circularly disposed backward guiding holes for sucking an airflow, when the rebound pressing space for ejecting airflow being adjusted to correspond with the air inlet, the outer conical surface at the front end of the small diameter section and an inner end of the small diameter tube correspondingly form a circular opening for ejecting airflow, when the airflow switching and controlling element being adjusted forward to push the outer conical surface and to reduce the circular opening for ejecting airflow, the ejecting airflow being compressed for increasing the airflow pressure, and the air in the back inside the gun body being drawn to move forward for increasing the pressure of ejecting.

* * * * *